United States Patent [19]

Heitmann

[11] Patent Number: 5,060,665

[45] Date of Patent: Oct. 29, 1991

[54] WRAPPING MECHANISM FOR ROD MAKING MACHINES OF THE TOBACCO PROCESSING INDUSTRY

[75] Inventor: Uwe Heitmann, Hamburg, Fed. Rep. of Germany

[73] Assignee: Körber AG, Hamburg, Fed. Rep. of Germany

[21] Appl. No.: 664,616

[22] Filed: Mar. 4, 1991

[30] Foreign Application Priority Data

Mar. 5, 1990 [DE] Fed. Rep. of Germany ..... 4006843

[51] Int. Cl.[5] ..... A24C 5/14; A24C 5/18

[52] U.S. Cl. ..... 131/84.1; 131/84.3; 493/39

[58] Field of Search ..... 131/84.1–84.4, 131/58, 60, 66.1; 493/4, 39, 42, 44, 45

[56] References Cited

U.S. PATENT DOCUMENTS

| | | | |
|---|---|---|---|
| 4,574,816 | 3/1986 | Rudszinat | 131/84.4 |
| 4,632,130 | 12/1886 | Heitmann et al. | 131/84.4 X |
| 4,651,754 | 3/1987 | Lorenzen | 131/84.4 |
| 4,697,603 | 10/1987 | Steinhauer | 131/84.4 |
| 4,856,539 | 8/1989 | Lorenzen | 131/290 |
| 4,945,927 | 8/1990 | Belvederi | 131/84.1 |

FOREIGN PATENT DOCUMENTS

| | | | |
|---|---|---|---|
| 0731963 | 4/1966 | Canada | 131/84.4 |
| 2139073 | 7/1987 | United Kingdom . | |

*Primary Examiner*—V. Millin
*Assistant Examiner*—J. Doyle
*Attorney, Agent, or Firm*—Peter K. Kontler

[57] ABSTRACT

A cigarette rod making or filter rod making machine wherein the wrapping mechanism employs an endless garniture belt having an upper reach which advances first along an upwardly sloping and thereupon along a horizontal portion of an endless path. A web of wrapping material is delivered onto the upwardly sloping portion of the upper reach, and such web is thereupon converted into a tube which is draped around a rod-like filler of fibrous material. The filler is delivered by the horizontal and/or upwardly sloping lower reach of a foraminous endless belt conveyor in such a way that is reaches the web substantially at the locus between the upwardly sloping and horizontal portions of the upper reach of the garniture belt. The upwardly sloping portion of the upper reach of the garniture belt and the adjacent substantially horizontal portion of the lower reach of the endless belt conveyor define a wedge-like space which narrows in a direction toward the horizontal portion of the path for the upper reach of the garniture belt. The upwardly sloping portion of the upper reach of the garniture belt makes with a horizontal plane an angle of 3°–5°. The lower reach of the endless belt conveyor can be composed of two portions which make an angle of 175°–177°.

11 Claims, 1 Drawing Sheet

WRAPPING MECHANISM FOR ROD MAKING MACHINES OF THE TOBACCO PROCESSING INDUSTRY

BACKGROUND OF THE INVENTION

The invention relates to rod making machines of the tobacco processing industry, especially to cigarette rod making and filter rod making machines. More particularly, the invention relates to improvements in wrapping mechanisms for use in rod making machines of the above outlined character. The following description will refer primarily to cigarette rod making machines with the understanding, however, that the invention can be embodied with equal advantage in wrapping mechanisms of machines which are designed to make other rod-shaped tobacco-containing products as well as rod-like articles which contain filter material for tobacco smoke.

The wrapping mechanism of a cigarette rod making machine (e.g., a machine known as PROTOS which is made and distributed by the assignee of the present application) employs a first endless belt conveyor (known as garniture) which cooperates with stationary guide means to gradually convert a continuously supplied web of cigarette paper or other suitable wrapping material into a tube and to simultaneously drape the web around a continuous rod-like tobacco-containing filler. The latter is supplied by a second endless belt conveyor which is preferably permeable to air so that tobacco particles can be caused to adhere thereto by suction in a manner well known from the art of cigarette making. As a rule, that reach or stretch of the second conveyor which delivers the filler defines a downwardly sloping path terminating in the region where the web of wrapping material undergoes a curling or analogous deforming action to be converted into a tube which is thereupon sealed by adhesive to confine the rod-like filler and to advance the resulting cigarette rod toward a cutoff or another suitable device serving to subdivide the rod into plain cigarettes of unit length or multiple unit length. It is presently preferred to feed a shower of tobacco particles upwardly within a duct having a discharge end at the underside of the lower reach of the second belt conveyor; the tobacco particles are converted into a stream which contains a surplus of tobacco and such stream is thereupon trimmed or equalized by removing the surplus of fibrous material. The trimmed stream constitutes the filler and is advanced into the range of the wrapping mechanism. The upper reach of the first belt conveyor is horizontal, the same as that portion of the web of wrapping material which is delivered onto and is shaped by the first conveyor.

OBJECTS OF THE INVENTION

An object of the invention is to provide a novel and improved wrapping mechanism for use in a rod making machine of the tobacco processing industry, particularly a cigarette rod making or filter rod making machine.

Another object of the invention is to improve the delivery of successive increments of a rod-like filler of fibrous material to the wrapping station in a rod making machine of the tobacco processing industry.

A further object of the invention is to provide a machine which embodies the above outlined wrapping mechanism.

An additional object of the invention is to provide a wrapping mechanism wherein the draping conveyor for wrapping material and the conveyor which supplies the filler are positioned or oriented in a novel and improved way.

Still another object of the invention is to a novel and improved transition zone or region where the rod-like filler of tobacco or filter material reaches the web of wrapping material.

SUMMARY OF THE INVENTION

The invention is embodied in a machine (such as a cigarette rod making machine or a filter rod making machine) wherein a filler of fibrous material is draped into a deformable web of wrapping material. More particularly, the invention resides in the provision of a wrapping mechanism which can be used in a cigarette rod making or filter rod making machine and includes an endless belt conveyor (e.g., a belt conveyor of the type known as garniture), means for advancing the belt conveyor in a predetermined direction along an endless path, and means for gradually converting the conveyor into a tube in a first portion of the path by gradually moving the marginal portions of the belt conveyor toward each other. The path has an upwardly sloping second portion which is located upstream of the first portion and the wrapping mechanism further comprises means for supplying the web onto the belt conveyor in the second portion of the path so that the web advances upwardly in the second portion and is thereupon converted into a tube jointly with the belt conveyor in the first portion of the path. Still further, the wrapping mechanism comprises a second conveyor having an elongated horizontal or upwardly sloping reach which delivers the filler onto the web at the first portion of the path.

The second conveyor preferably includes an endless belt conveyor (hereinafter called band conveyor to distinguish from the belt conveyor in the predetermined path). The elongated reach of the band conveyor and the belt conveyor portion in the second portion of the path define a space (e.g., a substantially funnel-shaped space) which narrows gradually in a direction toward the first portion of the path. The elongated reach can constitute the lower reach of the band conveyor, and the belt conveyor then preferably comprises an upper rach in the first and second portions of the path.

The elongated reach can include an upwardly sloping first portion and a substantially horizontal second portion between the upwardly sloping first portion and the first portion of the path. The aforementioned space is defined by the substantially horizontal second portion of the elongated reach and the belt conveyor portion in the second portion of the path. The first and second portions of the elongated reach can make an angle of between 175 and 177.

The second portion of the path can be inclined with reference to a horizontal plane through an angle of between 2 and 820 , preferably 4 and 6°.

If the fibrous material contains or consists of tobacco, the wrapping mechanism further comprises means for feeding tobacco to the elongated reach of the second conveyor.

If the fibrous material contains or consists of filter material for tobacco smoke, the wrapping mechanism comprises means for feeding fibrous material to the elongated reach of the second conveyor.

The novel features which are considered as characteristic of the invention are set forth in particular in the appended claims. The improved wrapping mechanism itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
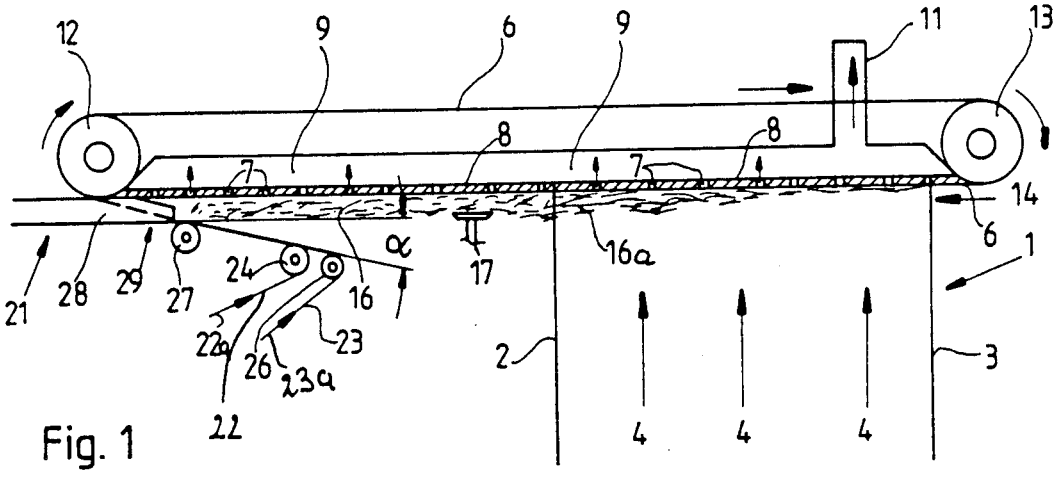
FIG. 1 is a somewhat schematic partly elevational and partly vertical sectional view of a wrapping mechanism which is installed in a rod making machine of the tobacco processing industry and is constructed and assembled in accordance with a first embodiment of the invention, the conveyor which delivers the filler to the wrapping station defining a substantially horizontal path for the filler.

FIG. 1 shows a portion of a wrapping mechanism which is installed in a cigarette rod making machine, e.g., a machine known as PROTOS. The wrapping mechanism comprises an endless belt conveyor 22 which is known as garniture and is driven by a pulley 24 to advance along an endless path in the direction indicated by arrow 22*a*. The path for the conveyor 22 includes a substantially horizontal first portion 21 which begins at a pulley 27 and extends along a stationary guide 28 serving to gradually convert the conveyor 22 into a tube by curling the marginal portions of the upper reach of the conveyor 22 upwardly and toward each other in a manner well known from the field of draping webs of wrapping material around rod-like fillers. The path portion 21 is preceded by an upwardly sloping second path portion between the pulleys 24 and 27; this second path portion makes with a horizontal plane a relatively small acute angle of 2 to 8°, preferably an angle of 4 to 6°.

A pulley 26 delivers a continuous deformable web 23 of cigarette paper or other suitable wrapping material which advances in the direction of arrow 23*a* and is delivered onto the upper reach of the conveyor 22 in the second portion of the path (between the pulleys 24 and 27). This ensures that the web 26 advances along the upwardly sloping second portion of the path and is thereupon converted into a tube jointly with the conveyor 22. Such tube is draped around a continuous rod-like filler 16 which is delivered by a second endless belt or band conveyor 6 trained over pulleys 12, 13 and driven by at least one of these pulleys so that its substantially horizontal lower reach advances in the direction of arrow 14.

The right-hand portion of the lower reach of the conveyor 6 advances above the upper end of a duct 1 which constitutes a means for feeding a shower of tobacco particles (particularly shreds of tobacco leaf laminae) in the direction of arrows 4. The shower of ascending tobacco particles is confined between the substantially vertical walls 2, 3 of the duct 1, and such particles are attracted to the underside of the lower reach of the conveyor 6 by suction in a chamber 9. The latter is disposed between the upper and lower reaches of the conveyor 6 and has an outlet 11 connected to a suction generating device, e.g., to the intake of a fan, not shown. The bottom wall 8 of the suction chamber 9 is perforated, as at 7, so as to enable streamlets of air to pass from below through the lower reach of the conveyor 6, through the bottom wall 8 and into the interior of the suction chamber. The ascending particles which gather at the underside of the lower reach of the conveyor 6 are converted into a stream 16*a* which begins to grow at the wall 3 and is fully grown at the wall 2. The fully grown stream 16*a* contains a surplus of tobacco particles, and such surplus is removed by a conventional trimming or equalizing device 17 which converts the stream 16*a* into the rod-like filler 16. The filler 16 continues to advance to the underside of the lower reach of the conveyor 6 on its way toward the first portion of the endless path for the conveyor 22, namely toward the pulley 27 (at the locus 29) where the filler is released to contact the upper side of and to advance with the web 23 on the conveyor 22 into the wrapping station. The web 23 is draped around the filler 16 in such a way that one of its marginal portions extends tangentially from the filler and can be coated with adhesive by a suitable paster. The coated marginal portion is then caused to overlie the other marginal portion of the web 23 so that the two marginal portions form a seam extending in parallelism with the axis of the resulting cigarette rod. The adhesive of the seam is then heated by one or more plate-like sealers to ensure that the adhesive sets before the respective increment of the cigarette rod reaches the aforementioned cutoff which divides the rod into sections of unit length (plain cigarettes) or multiple unit length. The manner of applying adhesive, forming the seam, heating the seam and cutting the cigarette rod forms no part of the invention. For example, the non-illustrated portions of the wrapping mechanism can be constructed and assembled and can operate in a manner as disclosed in British Pat. No. 2 139 073.

The substantially funnel-shaped or wedge-like space between the left-hand end portion of the lower reach of the conveyor 6 and the conveyor 22 in the path portion between the pulleys 24, 27 tapers or narrows toward the locus 29 of entry of the web 23 into the deforming or tube forming part of the wrapping mechanism. The conveyor 22 serves to advance the web 23 and the filler 16 through the draping station of the wrapping mechanism.

An advantage of the improved wrapping mechanism is that the filler 16 can reach the web 23 by advancing along a substantially horizontal path and comes into contact with successive increments of the web, namely with increments in the region (locus 29) which can be said to be the downstream part of the ascending portion of the path of the web 23 or the upstream part of the horizontal portion of the path for the web with the conveyor 22. Moreover, the improved wrapping mechanism ensures that the filler 16 can be compacted during movement along the entire first portion of the path for the conveyor 22, i.e., all the way from the locus 29 at the pulley 27 to the location where the finished cigarette rod leaves the wrapping mechanism to advance toward the cutoff.

A conventional wrapping mechanism wherein the filler is delivered along a downwardly sloping path to contact a horizontal portion of the web on the garniture belt is disclosed, for example, in commonly owned U.S.

Pat. No. 4,856,539 to Lorenzen, in commonly owned U.S. Pat. No. 4,651,754 to Lorenzen et al., in commonly owned U.S. Pat. No. 4,697,603 to Steinhauer et al., and in commonly owned U.S. Pat. No. 4,574,816 to Rudszinat. The disclosure of Rudszinat is incorporated herein by reference because this patent shows and describes a source of wrapping material, a paster, a tandem sealer for adhesive in the seam between overlapping portions of the draped web, and a cutoff which severs the cigarette rod downstream of the wrapping mechanism.

Figure 2:
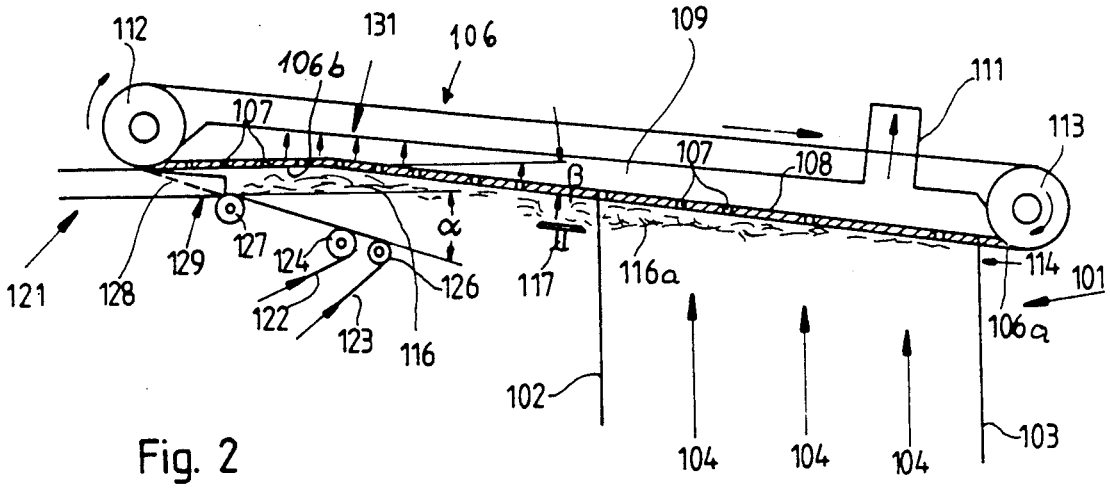
FIG. 2 is a similar schematic partly elevational and partly vertical sectional view of a wrapping mechanism wherein the conveyor which delivers the filler defines a different path having an upwardly sloping portion and a substantially horizontal portion.

FIG. 2 shows a portion of a modified wrapping mechanism wherein all such parts which are identical with or clearly analogous to corresponding parts of the wrapping mechanism of FIG. 1 are denoted by similar reference characters plus 100. The main difference between the two wrapping mechanisms is that the endless band or belt conveyor 106 of FIG. 1 has an elongated lower reach with an upwardly sloping first portion 106*a* above the open upper end of the tobacco feeding duct 101, and a substantially horizontal second portion 106*b* serving to deliver successive increments of the filler 116 onto the web 123 at the location 129, i.e., in the region which can be said to constitute the discharge end of the second portion or the intake end of the first portion of the path for the belt conveyor 122. The portions 106*a*, 106*b* of the lower reach of the conveyor 106 make an angle 180° minus beta wherein beta is normally between 3° and 5°, preferably close to 4°.

It will be noted that the growing tobacco stream 116*a* between the walls 102, 103 of the duct 101 has a (vertical) component of movement which is parallel to the direction (arrows 104) of upward movement of tobacco particles in the duct 101. Such design of the conveyor 106 has been found to ensure a more satisfactory stream building action at the upper end of the duct 101. As explained hereinabove, and as shown in the aforementioned commonly owned patents to Lorenzen, Lorenzen et al., Steinhauer et al. and Rudszinat, the lower reaches of conventional tobacco delivering conveyors normally slope downwardly toward the locus of transfer of the filler onto a web of wrapping material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine for making a rod wherein a filler of fibrous material is draped into a deformable web of wrapping material, a wrapping mechanism including an endless belt conveyor; means for advancing said conveyor in a predetermined direction along an endless path; means for gradually converting the conveyor into a tube in a first portion of said path, said path having an upwardly sloping second portion upstream of said first portion; means for supplying the web onto said conveyor in the second portion of said path so that the web advances upwardly in said second portion and is thereupon converted into a tube jointly with said conveyor in the first portion of said path; and a second conveyor having an elongated horizontal or upwardly sloping reach which delivers the filler onto the web at the first portion of said path.

2. The wrapping mechanism of claim 1, wherein said second conveyor includes an endless band conveyor, said elongated reach and the belt conveyor in the second portion of said path defining a space which narrows gradually in a direction toward said first portion of said path.

3. The wrapping mechanism of claim 2, wherein said space is substantially funnel-shaped.

4. The wrapping mechanism of claim 2, wherein said reach is the lower reach of said band conveyor, said belt conveyor having an upper reach in the first and second portions of said path.

5. The wrapping mechanism of claim 2, wherein said reach has an upwardly sloping first portion and a substantially horizontal second portion between said upwardly sloping first portion and the first portion of said path.

6. The wrapping mechanism of claim 5, wherein said space is defined by said substantially horizontal second portion of said reach and the belt conveyor in the second portion of said path.

7. The wrapping mechanism of claim 5, wherein said first and second portions of said reach make an angle of 175 to 177.

8. The wrapping mechanism of claim 1, wherein the second portion of said path is inclined with reference to a horizontal plane through an angle of between 2 and 8°.

9. The wrapping mechanism of claim 8, wherein said angle is between 4 and 6°.

10. The wrapping mechanism of claim 1, wherein the fibrous material contains tobacco, and further comprising means for feeding tobacco to said reach of said second conveyor.

11. The wrapping mechanism of claim 1, wherein the fibrous material contains filter material for tobacco smoke and further comprising means for feeding filter material to said reach of said second conveyor.

* * * * *